United States Patent [19]

Butcher

[11] 4,100,893

[45] Jul. 18, 1978

[54] PRESSURE-RESPONSIVE TRANSDUCER FOR REGULATING INTERNAL COMBUSTION ENGINE

[76] Inventor: David Henry Butcher, Stanford House, Slinfold, near Horsham, Sussex, England

[21] Appl. No.: 555,302

[22] Filed: Mar. 4, 1975

[30] Foreign Application Priority Data

Mar. 7, 1974 [GB] United Kingdom ..... 10193/74

[51] Int. Cl.[2] ..... F02D 11/08

[52] U.S. Cl. ..... 123/103 B; 123/103 C; 180/108

[58] Field of Search ..... 123/103 C, 103 R, 103 E; 180/108; 340/407; 74/513

[56] References Cited

U.S. PATENT DOCUMENTS

| | | | |
|---|---|---|---|
| 2,139,832 | 12/1938 | Leibing | 123/103 C |
| 2,585,814 | 2/1952 | McDonald | 123/103 R |
| 2,692,980 | 10/1954 | Platt | 123/103 C |
| 2,825,418 | 3/1958 | Kershman | 123/103 C |
| 2,853,985 | 9/1958 | Landrum | 123/103 C |
| 3,888,219 | 6/1975 | Rodgerson | 123/97 R |
| 3,923,020 | 12/1975 | Gilligan | 123/103 C |

FOREIGN PATENT DOCUMENTS

| | | | |
|---|---|---|---|
| 751,217 | 8/1933 | France | 180/108 |
| 905,559 | 3/1954 | Fed. Rep. of Germany | 123/103 C |

*Primary Examiner*—Charles J. Myhre
*Assistant Examiner*—Craig R. Feinberg
*Attorney, Agent, or Firm*—A. W. Breiner

[57] ABSTRACT

Apparatus for regulating an internal combustion engine comprises a pressure-responsive transducer, preferably of the diaphragm type, adapted for connection with the intake duct of the engine to respond to air pressure therein, and mechanical output means responsive to that pressure for actuating a throttling device to oppose increase of pressure. The throttling device may be a normal throttling device, e.g. the throttling device on the carburetor of a motor vehicle, or it may be provided in addition thereto. With the apparatus fitted to a motor vehicle, a significant improvement in fuel economy is obtained by a wide class of drivers.

The apparatus may be arranged for simple connection within the mechanical linkage connecting the throttle pedal of a motor vehicle with the existing throttling device.

14 Claims, 7 Drawing Figures

PRESSURE-RESPONSIVE TRANSDUCER FOR REGULATING INTERNAL COMBUSTION ENGINE

Figure 1:
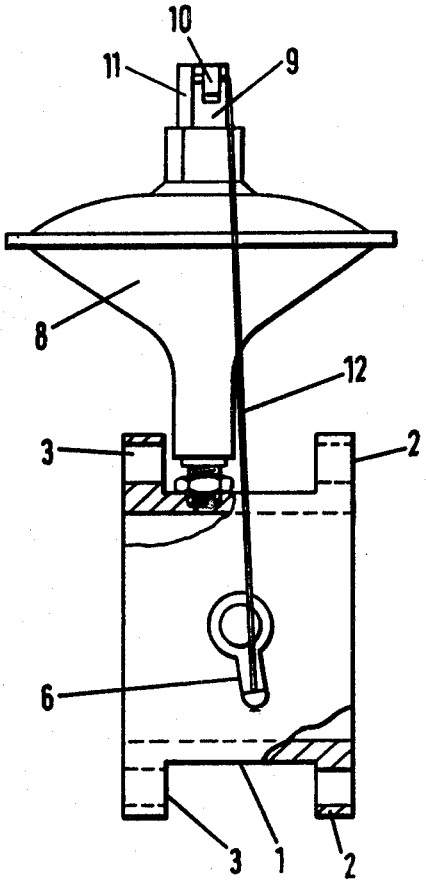

The present invention relates to valve devices.

An internal combustion engine of the kind fitted to motor vehicles normally has a movable throttling device followed by an air intake duct for supplying the engine with air for the combustion of the fuel employed. A single intake duct, provided in the form of an intake manifold, may supply all the cylinders of the engine with air. In another arrangement, there may be two or more intake ducts, each with its own throttling device, each for supplying air only to its own cylinder or set of cylinders. With most engines the throttling device is provided as part of a carburettor in which the fuel, usually of the light hydrocarbon type, is vaporized in the required amount in the air passing to the intake duct. With other engines the fuel is injected in measured amounts into the cylinders or into the duct beyond the throttling device.

It is an object of the present invention to provide apparatus by which the fuel economy of an internal combustion engine having a movable throttling device especially when fitted to a motor vehicle may be improved.

By the present invention, there is provided an apparatus for regulating an internal combustion engine having, for supplying air to the engine, a movable throttling device followed by an air intake duct, said apparatus comprising a pressure-responsive transducer adapted for connection with the intake duct to respond to air pressure therein, and mechanical output means responsive to the transducer, and thence to said air pressure, for actuation of the throttling device to oppose increase of said air pressure.

The movable throttling device restricts the flow of air from the atmosphere into the duct. Accordingly, the pressure in the duct is less than atmospheric pressure by an amount which depends upon the position of the throttling device and the rate of flow of the air. In use, the apparatus is adjusted to maintain the pressure in the duct at or below a chosen level below atmospheric pressure, the transducer acting to oppose increase of pressure above the chosen level. It is found that with the apparatus suitably installed on a motor vehicle, a significant improvement in fuel economy is readily obtainable by a wide class of drivers, and little or no effort is required for a driver to accustom himself to driving with the apparatus. The degree of improvement depends upon the driver. It is minimal for the extreme cases of drivers who customarily avoid high rates of acceleration and braking, and drivers who habitually make excessive use of low gear ratios under conditions of reduced engine performance. For the majority of drivers, who are between these extremes, the improvement is significant and it can be substantial e.g. from 8% to 14%. It must be understood however that the saving even for any one driver is not constant but depends upon the kind of journey made.

It is advantageous to provide the apparatus with an over-riding device arranged to over-ride the action of the transducer when required. The over-riding device may be arranged to operate automatically when the throttle operating pedal of the vehicle is depressed more than a predetermined amount and/or in response to a manually operable selector. It enables maximum engine power to be obtained for special purposes including emergencies.

According to one form of the apparatus, the said mechanical output means is a linkage connected with the throttling device and the throttling device is an auxiliary throttling device for use in addition to a normal throttling device for normal control of the engine. According to a preferred construction of apparatus of this form, the said auxiliary throttling device is mounted within a mounting constructed for through-airflow connection with the intake duct and the transducer is mounted upon said housing.

According to another form of the apparatus provided for simplicity of installation, and to increase the range of types of vehicle for which an apparatus of given dimensions is suitable, the mechanical output means has a mechanical input connection and a mechanical output connection spaced apart from one another and the transducer is operable to vary the spacing between the input and output connections for said actuation of the throttling device. Apparatus of this form may be installed in the mechanical linkage between the throttle pedal and the engine of a vehicle. In varying the spacing between the input and output connections, the transducer modifies the movement of the normal throttling device of the engine. No separate throttling device is required.

The transducer is conveniently mounted between the input and output connections. Two types of mechanical linkage are common, viz. firstly the push rod type in which an articulated arrangement of push rods pushes the throttling device open, and secondly the cable type in which a cable pulls the throttling device open. For use with the first type, the present apparatus is provided with output connections of the push rod type and said transducer is arranged to decrease said spacing in response to rise of said air pressure. For use with the second type, the present apparatus is provided with input and output connections in the form of throttle cable connections and said transducer is arranged to increase said spacing in response to rise of said air pressure.

The transducer employed in apparatus according to the invention is preferably one which produces the required mechanical movement directly in response to pressure changes, e.g. a piston type transducer or a diaphragm type transducer, the latter being preferred. More complex arrangements may be employed if desired, e.g. a transducer providing an electrical output signal in response to pressure in association with an electronic amplifier and an electrically driven actuator providing a mechanical output. Such arrangements may be adopted where it is desired to compensate for variables, e.g. engine temperature or ambient pressure or temperature.

According to a preferred arrangement in which the transducer is operable to vary the spacing between mechanical input and output connections as aforesaid, the transducer is a housing divided by a diaphragm into two parts, one of which is adapted for connection with the intake duct, one of said mechanical connections is fixed with respect to the housing and the other thereof linked to the diaphragm for movement thereby.

Figure 2:
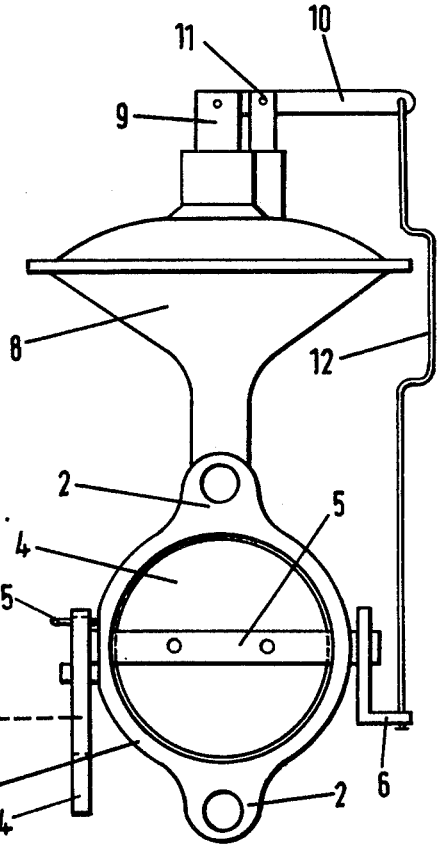
Figure 3:
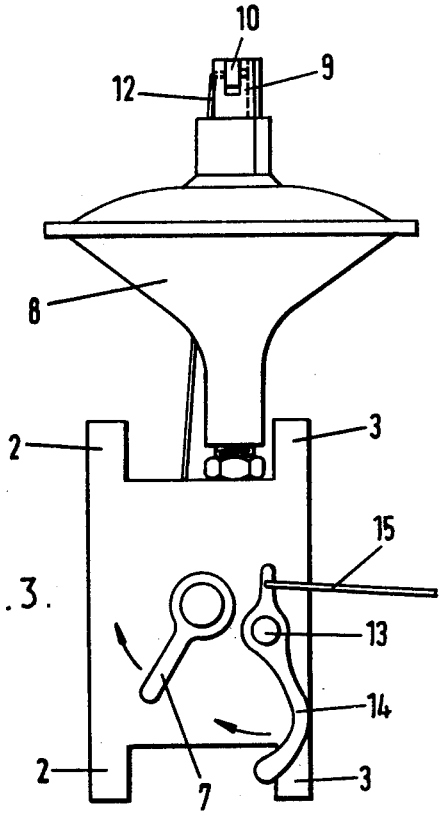
Figure 4:
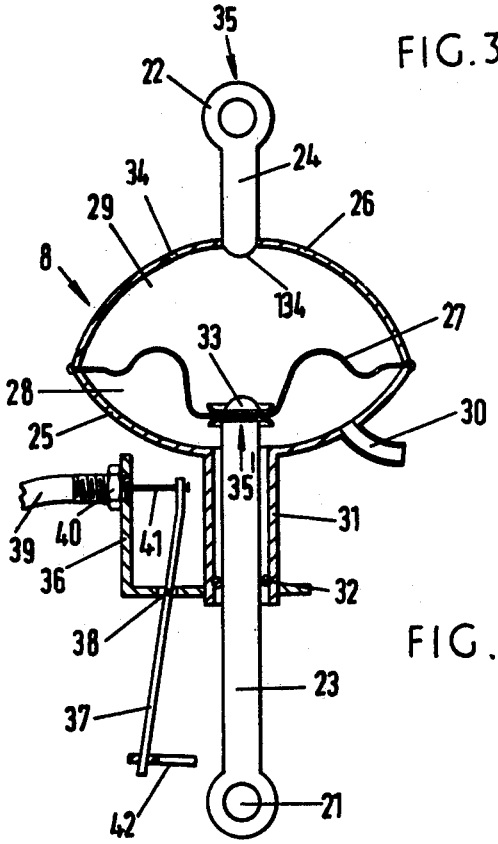
Figure 5:
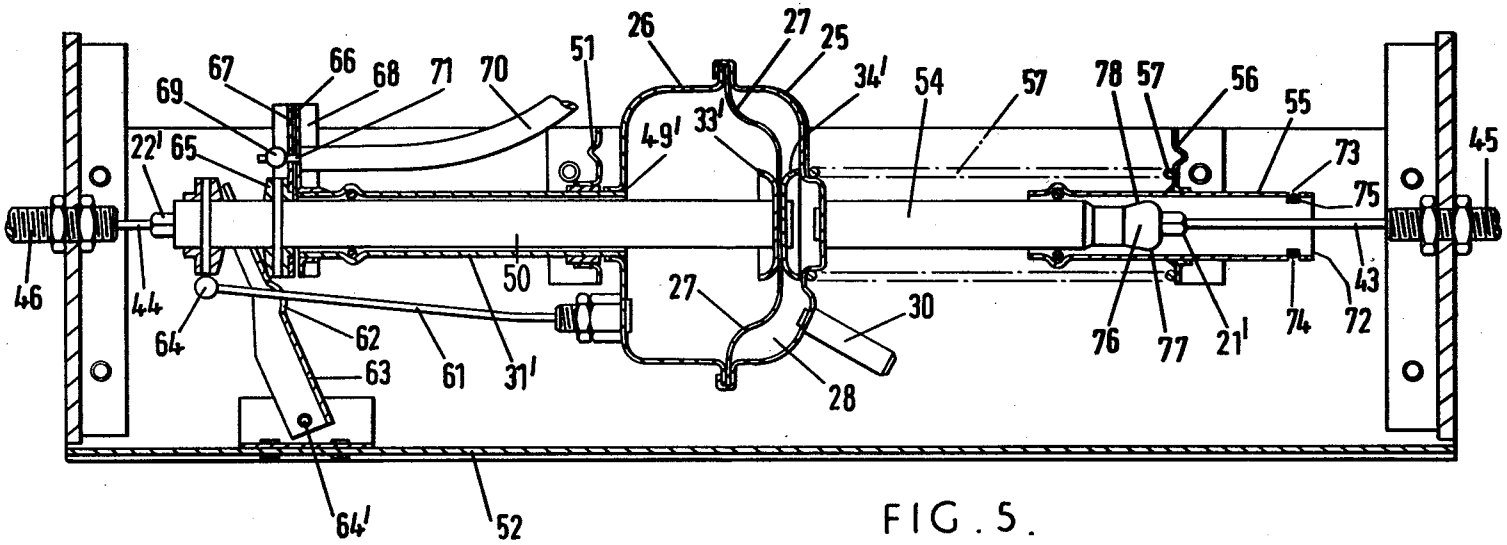
Figure 7:
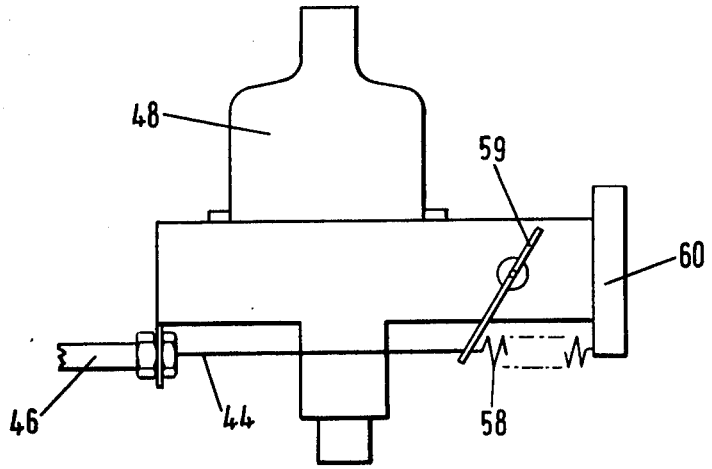
Figure 6:
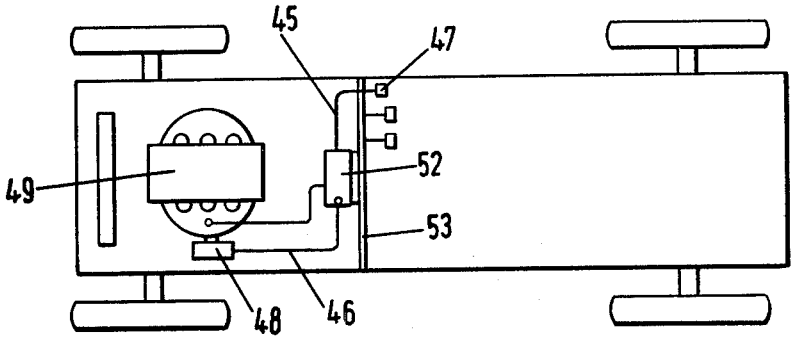

The following description in which reference is made to the accompanying drawings of preferred embodiments of apparatus according to the invention is given in order to illustrate the invention. In the drawings:

FIG. 1 is an elevation of one side of a first embodiment, parts being shown in cross section, said embodiment having its own throttling device, FIG. 2 is an elevation of one end of the embodiment of FIG. 1, FIG. 3 is an elevation of the opposite side of the embodiment of FIG. 1, FIG. 4 is a cross section of a second embodiment of the apparatus, said embodiment being adapted for connection in a push-rod linkage, FIG. 5 is a cross section of a third embodiment of the apparatus, said embodiment being adapted for connection in a cable linkage, FIG. 6 shows a motor vehicle fitted with the embodiment of FIG. 5, and FIG. 7 shows the connection of the cable linkage with the carburettor of the vehicle of FIG. 5.

In the embodiment of FIGS. 1 to 3, a mounting 1, of generally hollow cylindrical cross section bears at one end a pair of lugs 2 for bolting it to a carburettor and at the other end a pair of lugs 3 for bolting it to the intake duct. Within the housing is a butterfly valve plate 4, mounted upon a rotary spindle 5 which extends through both sides of the housing 1 and carries an operating lever 6 and a control lever 7 at its opposite ends.

Mounted on top of the housing 1, and communicating with the interior thereof, is a transducer 8 having an internal diaphragm (not shown) which as pressure in the housing 1 falls, pulls a plunger 9 downwardly. An operating arm 10 articulated to rod 9 and mounted upon a fulcrum 11 is thereby caused to pull a valve operating rod 12 upwardly to move operating lever 6 and rotate valve plate 4 in its opening direction.

Control lever 7 is rotated with the valve plate. Riveted to the housing 1 at 13 is an over-ride lever 14 having a cable connection 15 for connection with the normal throttle control of the carburettor.

With an engine running at idling speed, the pressure in the intake duct and the mounting 1 is minimum and the valve plate 4 is turned into the horizontal, fully open, position by the transducer 8. The normal effect of speeding-up the engine is to increase the pressure. This increase is progressively opposed when it tends to increase above a minimum, e.g. 20 inches of mercury, by progressive rotation of the valve plate 4 towards the vertical, closed, position. Control lever 7 rotates with the plate 4. Over-ride lever 14 is arranged to swing in the direction of the lever 7 as the throttle control is moved in the speed increase direction. When the throttle control reaches a particular setting, e.g. 70% of maximum lever 14 engages lever 7 to over-ride the transducer 8 by moving the valve plate 4 towards the horizontal, open, position. Thus full engine power is available when required.

The embodiment of FIG. 4 is designed to replace one of the members of an articulated system of push rods connecting the throttle pedal of a vehicle with the throttling device (butterfly valve) of the vehicle's carburettor, the throttling device being opened by a push by the system. Input and output connections 21 and 22 respectively are provided in the form of eyes at the ends of rod members 23 and 24. These eyes are similar to eyes at the ends of the member which the apparatus replaces.

Rod member 24 is rigidly mounted upon the exterior of the transducer 8 which has a housing formed of two sections 25 and 26 seamed to the circular periphery of a diaphragm 27 which divides the housing internally into two parts, viz. a lower part 28 and an upper part 29. Section 25 has a nipple 30 for connection with the intake manifold or one of the intake ducts, of the vehicle's engine. Additionally, section 25 has an intergral neck 31 provided near its outer end with an internal sealing ring 32 through which rod member 23 passes in a slidable, substantially air-tight, manner. The center of the diaphragm 27 is secured between the end of rod member 23 and an abutment 33.

A vent 34 in section 26 maintains part 29 at atmospheric pressure.

When rod member 23 is pushed with part 28 at a low pressure, the diaphragm is maintained at its lowermost position by atmospheric pressure and the distance between eyes 21 and 22 remains fixed at a maximum. The throttling device of the vehicle then responds normally to the throttle pedal. If, however, the pressure in part 29 is high, the diaphragm is pushed upwardly until abutment 33 engages an abutment 34 inside the top of section 26. Because of the resulting lost motion, the response of the throttling device is reduced, e.g. to one third open when the pedal is fully depressed.

As the throttling device is opened, the normal spring loading thereof exerts an increasing load shown as arrow 35 upon eye 22. This loading gives a reaction shown as arrow 35′ which opposes downward movement of the diaphragm in its housing. By adjusting the spring loading the embodiment of FIG. 4 is made to operate so that the pressure in part 28, and thence in the duct following the carburettor, is maintained below a predetermined minimum, e.g. below from one half to two thirds of atmospheric pressure.

When an engine having two or more carburettors, of which the throttling devices are actuated together by the push rod system, the nipple 30 is connected with only one of the intake ducts.

A bracket 36 secured to neck 31 has a lever 37 carried by a pivotal mounting 38. The outer sleeve 39 of a control cable is secured to the bracket at 40 and the movable inner part 41 of the cable is attached to lever 37 so that when inner part 41 is pulled, a fork 42 engages around rod number 23 above eye 21. In its engaged position, fork 42 holds the distance between eyes 21 and 22 at or near the maximum to inactivate the effect of the diaphragm. By operating the control cable, the driver can set his engine for normal response to the throttle pedal.

The embodiment of FIG. 5 has a mechanical input 21′ and a mechanical output 22′ in the form of connections for the inner parts 43 and 44 of control cables 45 and 46 leading respectively from the throttle pedal 47 and to the carburettor 48 of a motor vehicle having an engine 49 (FIG. 6). In this case, the part 26 of the transducer housing has a neck 31′ in the form of a tube secured at 49′ and part 25 has an internal abutment 34′ for diaphragm 27. A rod 50 slidable within the neck 31′ and carrying output 22′ is secured to the diaphragm 27. A cup member 33′ reinforces the center of the diaphragm for abutment with abutment 34′.

The neck and housing assembly 25, 26 and 31′ is slidable longitudinally in a bearing bracket 51 carried by a frame 52 mountable in any convenient position, e.g. upon the bulkhead 53 (FIG. 6). Input 21′ is carried by a rod 54 secured to part 25 of the transducer housing. This rod is slidable within a sleeve 55 carried by a bracket 56 on frame 52. A compression spring 57 surrounds sleeve 55 on one side of bracket 56 and bears upon this bracket and the transducer housing.

When the pressure in part 28 is sufficiently low, the distance between input 21' and output 22' is held fixed at a minimum. Pressing the pedal 47 against the force of spring 57 then produces a corresponding opening of the throttling device in carburettor 48 by a simple pull transmitted from cable 45 to cable 46. When the pressure in part 28 is high, pressing the pedal pulls rod 54 and housing 25, 26 but the diaphragm 27 flexes so that no pull is exerted upon rod 50. The throttling device of the carburettor 48 is held closed by the usual spring 58 acting upon lever 59 thereof (FIG. 7). Outlet side 60 of the carburettor connects of course with the intake manifold of engine 49. Spring 58 acts via cable 46 to hold rod 50 in its outermost position and provides the diaphragm flexing force.

A cable 61 extends from the transducer housing, through an aperture 62 in a lever 63 and is fitted with a cable nipple 64 adjustable in position. As the transducer is pulled against the force of spring 57 the cable is drawn through aperture 62 until nipple 64 engages the lever 63 which is pivoted to the frame 52 at 64'. Further pulling of the transducer housing causes the upper end (which is forked) of lever 63 to press against an abutment 65 on rod 50. Subsequent movement of the transducer housing is thus conveyed to the output 22' via cable 61 rather than via diaphragm 27. The velocity ratio given by lever 63 is such that the movement so obtained is amplified. The arrangement over-rides the transducer action when the throttle pedal is moved beyond a certain position and provides a usefully increased rate of throttle opening.

Two correspondingly apertured flanges 66 and 67 are provided, one on the rod 50 and the other on a bracket 68 secured to frame 52. When the apparatus is in its shortest-length condition shown in FIG. 5, these flanges are substantially in contact. In FIG. 5 the flanges are shown locked together by an abutment 69 at the end of a cable 70 the inside, actuating part 71, which passes through the apertures of the flanges is operable by the driver to render the apparatus ineffective. For the apparatus to operate as described hereinbefore, a driver's control (not shown) is released so that part 71 of the cable positions abutment 69 away from flange 67 (i.e. to the left thereof as seen in FIG. 5).

In order to make the driver aware of lever 63 commencing operation, the sleeve 55 is formed near end 72 thereof with a pair of slots 73 and 74 in which are engaged two legs of a spring clip 75. As lever 63 begins to operate, the end 76, shaped as shown, of rod 54 meets clip 75. Drawing the steep part 77 of end 76 through the clip 75 requires an extra force discernible to the driver. Return of the end 76 through the clip is facilitated by the gentle taper at 78.

Substantial fuel economy is obtained by correct setting of carburettor spring 58 while retaining the availability of full power as required.

With the normal arrangement of the movable throttling device of an internal combustion engine and the control therefor, of which the most important case is the butterfly valve of a carburettor on the engine of a motor vehicle and the throttle pedal of the vehicle, the control is movable progressively through a range of positions and the throttling device follows this movement. For any position of the control the throttling device thus has a corresponding position. The transducers of the apparatus of FIGS. 4 to 7 act to set the throttling device away from its corresponding position, in the direction of its closed position, so that increase of pressure in the manifold or other duct beyond the throttling device in response to movement of the control is opposed.

It will be understood that the embodiments specifically described herein are given by way of example and are not intended to limit the scope of the invention claimed.

I claim:

1. Apparatus for regulating an internal combustion engine having, for supplying air to the engine, a movable throttling device followed by an air intake duct and having an operator's control member linked with the engine for controlling the speed thereof, said control member being movable between a minimum speed position and a maximum speed position, said apparatus comprising a pressure responsive transducer adapted for connection with the intake duct to respond to air pressure therein, mechanical output means responsive to the transducer, and thence to said air pressure, for actuation of the throttling device to oppose increase of said air pressure, when the control member is moved within a range extending from the minimum speed position to an intermediate position short of the maximum speed position and means separate from the transducer adapted and arranged to over-ride the mechanical output means and thereby prevent said opposition to increase of said air pressure when the control member is moved between said intermediate position and said maximum speed position.

2. Apparatus according to claim 1 in which said mechanical output means is a linkage connected with the throttling device and the throttling device is an auxiliary throttling device for use in addition to a normal throttling device for normal control of the engine.

3. Apparatus according to claim 2 in which the said auxiliary throttling device is mounted within a mounting constructed for through-air-flow connection with the intake duct and the transducer is mounted upon said housing.

4. Apparatus for regulating an internal combustion engine having, for supplying air to the engine, a movable throttling device followed by an air intake duct and having an operator's control member which is movable between a first position in which the throttling device is closed, and a second position, to open the throttling device progressively, said apparatus having a mechanical input connection for connection with the control member, a mechanical output connection, spaced apart from the mechanical input connection, for connection with the throttling device, a pressure responsive transducer adapted for connection with the intake duct to respond to air pressure therein and having a mechanical output operable to vary the spacing between the mechanical input connections to oppose opening of the throttling device and consequent increase of said air pressure when the control member is moved, in the throttling device opening direction, within a range extending from the first position to an intermediate position short of the second position, and over-riding means separate from the transducer adapted and arranged to over-ride the opposition when the control member is moved between the intermediate position and the second position.

5. Apparatus according to claim 4 in which the transducer is mounted between the input and output connections.

6. Apparatus according to claim 4 in which the input and output connections are of the push rod type and said transducer is arranged to decrease said spacing in response to rise of said air pressure.

7. Apparatus according to claim 4, in which the input and output connections are throttle cable connections and said transducer is arranged to increase said spacing in response to rise of said air pressure.

8. Apparatus according to claim 4 in which the transducer is a housing divided by a diaphragm into two parts, one of which is adapted for connection with the intake duct, one of said mechanical connections is fixed with respect to the housing and the other thereof linked to the diaphragm for movement thereby.

9. Apparatus according to claim 4 having manually operable locking means for locking the spacing between the mechanical input and output connections to a fixed amount to over-ride the opposition for all positions of the control member.

10. Apparatus according to claim 4 having reaction means operable to provide a reaction force at the mechanical input when the control member is moved through the intermediate position towards the second position.

11. Apparatus according to claim 4 having a part movable with the control member and the input connection, and a resiliently loaded member positioned to bear upon said part to produce a reaction force when said part is positioned at a locus corresponding with said intermediate position.

12. Apparatus according to claim 4 in which the over-riding means is a lost-motion arrangement providing a mechanical connection between the input and the output connections when the control member is moved between the intermediate position and the second position.

13. Apparatus according to claim 12 in which the lost-motion connection is provided by a lever formed with an aperture, a tension member having a mechanical connection with the input connection and passing through said aperture, and an abutment on the tension member for engaging the lever adjacent the aperture thereof when the control member reaches the intermediate position and moving the lever with maintenance of said engagement when the control member is moved from the intermediate position to the second position, and a further abutment having a mechanical connection with the output connection is arranged to be moved by reaction with said lever when the control member is moved between the intermediate position and the second position.

14. Apparatus according to claim 13 in which said lever is an end-pivoted lever and the aperture thereof is positioned such that the movement of the further abutment by reaction with the lever is larger than the movement of the abutment on the tension member.

* * * * *